US005793287A

United States Patent [19]

Anderson

[11] Patent Number: 5,793,287

[45] Date of Patent: Aug. 11, 1998

[54] SAFE FOR DISTRIBUTING PRIZES

[76] Inventor: J. W. Anderson, 841 N. Addison Ave., Elmhurst, Ill. 60126

[21] Appl. No.: 614,889

[22] Filed: Mar. 13, 1996

[51] Int. Cl.[6] ..... G08B 1/08

[52] U.S. Cl. ..... 340/539; 340/825.31; 340/825.56; 340/570; 70/57.1

[58] Field of Search ..... 340/539, 825.31, 340/825.56, 825.69, 825.72, 520, 571; 341/201, 176, 22; 70/63, 57.1, 436

[56] References Cited

U.S. PATENT DOCUMENTS

| | | | |
|---|---|---|---|
| 4,811,012 | 3/1989 | Rollins | 340/825.31 |
| 5,153,561 | 10/1992 | Johnson | 340/825.31 |
| 5,164,718 | 11/1992 | Cedergren | 340/825.31 |
| 5,252,960 | 10/1993 | Duhame | 340/825.56 |
| 5,349,345 | 9/1994 | Vanderschel | 340/571 |
| 5,475,376 | 12/1995 | Chikamitue et al. | 340/825.31 |
| 5,477,213 | 12/1995 | Atarashi | 340/825.31 |

*Primary Examiner*—Jeffery Hofsass
*Assistant Examiner*—Daryl C. Pope
*Attorney, Agent, or Firm*—Knechtel, Demeur & Samlan

[57] ABSTRACT

A device for distributing prizes comprising a safe having access thereto through a locking door. The locking mechanism on the door is controlled by means of a microprocessor. A player enters an input signal by means of either a pushbutton or dropping a card through a slot. A counter counts the number of input signals and compares it to a preset number. When the input signals equal the preset number, the latch on the door is released amid a flurry of lights and sounds. The prize within the safe can be withdrawn by the player. A remote control latch releasing means provides a means to override the counter to allow the operation of the locking mechanism so that a selected player can be allowed to remove the prize from the safe.

12 Claims, 4 Drawing Sheets

KEYPAD 0-9 KEYS
26
-24VDC
004
+24VDC.
KEYPAD # OR * KEYS
42
BROWN
KEYENCE EYE
MODEL #PZ2-42
46
BLUE
BLACK
60
KEYLESS
REMOTE
ENTRY
UNIT
KEYLESS ENTRY REMOTE
CONTROL
58
005
006
YELLOW/
RED
YELLOW/
RED
R1
R2
WHITE/BLUE
WHITE/RED
YELLOW/BLUE
007
RED
+12V+V3
-12V-V3
+V4
ENTRELEC RELAY
50
BLACK
-V4
504
R
12VDC DOOR SOLENOID
54
REMOTE
DISABLE
PANEL SWITCH
-24VDC
-12VDC
-V2
52
R
OFF
ON
008
BLACK
GREEN
62
+V2
+24VDC
+12 VDC

THUMBWHEEL SW.
48
1
2
4
8
C
9 9 9 9
1 2 4 8 C 1 2 4 8 C
500
000 002
001 003
501
502
503

BCD-8
BCD-2
+24V
EYE OR # OR * KEYS
KEYLESS ENTRY REMOTE ON-OFF
SPARE
44
C
000
001
002
003
004
005
006
007
008
009
BCD-1
BCD-4
REMOTE DISABLE PANEL SW.
KEYLESS ENTRY REMOTE ON-OFF
KV 16-T
BCD-10'2C.
RELAY DOOR SOLENOID
BCD-10'1C
BCD-10'0C
NC.
+24V
-24V
C
500
501
C
502
503
504
505
SPARE
BCD-10'3C.
+24VDC
-24VDC
3RD FLASHING LIGHT
IST FLASHING
-24VDC
C.
600
601
602
603
REMOTE ON LIGHT
2ND FLASHING LIGHT
KV-8EYT
4TH FLASHING LIGHT
WINNER LIGHT
604
605
606
607
-24VDC
NONE-WINNER
SOUND GENERATOR

SAFE FOR DISTRIBUTING PRIZES

This invention relates to a device used to assist in marketing and public relations and, more particularly, to a device used to distribute prizes or gifts in a unique way.

BACKGROUND AND SUMMARY OF THE INVENTION

Over the years, there have been many ideas and concepts for distributing prizes, gifts, or other promotional items in an effort to increase marketing and distribution of a company's products or services. For example, in department stores, it is common to find people distributing free samples of perfumes and cosmetics. Similarly, at trade shows, one can normally find sales personnel distributing free samples of a product or handing out brochures describing the product. The methods and products used to distribute prizes and/or literature is only limited by the imagination of the marketing person. Marketing of one's products or services is particularly well suited at trade shows, retail stores, parties, shopping centers, exhibitions, grand openings, hospitality suites, banks, and automobile dealers. The entrepreneur will go to extremes to get the attention of prospective purchasers.

Point of purchase devices are common in retail stores and supermarkets. Video monitors may display a product or service continuously or on demand. Electronically controlled speaker mechanisms may be activated when a potential purchaser approaches a display case or other location in a store. Models at a trade show or exhibition often try to get the attention of prospective purchasers by offering free prizes, gifts, or a chance to win a vacation. Generally speaking, the more creative the device to gain a prospective purchaser's attention, the more successful the promotion will be.

In Applicant's invention, the concept is to utilize a safe with either a keypad or card slot plate on top of the safe. Surrounding the keypad or card slot are flashing lights to gain the attention of a passerby. A prospective purchaser or customer is given a chance to play a game by entering his selected number on the keypad or by dropping his business card through the slot. If his entry is the lucky entry, the safe opens and the potential customer is allowed to withdraw the prize in the safe. The electronic circuitry within the safe is designed to open after a predetermined number of entries have been tried. Alternatively, the operator of the safe can utilize a wireless triggering device to override the counter and permit the next person to win. In this way, the operator of the device can assure special treatment for an important client, customer, or visitor. Furthermore, by changing an internal counter, the owner can provide control over the number of prizes awarded.

Applicant's device operates as a safe having an access door. Latching means controls the opening of the door. The user or contest player enters an input signal by means of a keypad or dropping a card through a slot. There is a counter which counts the number of times that users play the game. The counter compares the number of times played with a preset target number. When the number of times played equals the target number, a solenoid is operated which releases the latching means. A series of bells, buzzers, and lights go off indicating that there is a "winner." By means of a remote control latch releasing mechanism, the operator of the safe can cause the latch to be released for a particular customer or prospective customer. Once the latch releasing mechanism is activated, the player can remove the prize from the safe.

Accordingly, it is an object of the invention to provide a marketing device which provides for the distribution of prizes or gifts to customers or prospective customers.

Another object is to have a safe having a safe door which allows the operator to place prizes in the safe. A related object is the object of selectively having the access door opened by means of players inputting an input signal into a control mechanism. Another object is the object of providing a control mechanism by which the number of prizes which will be distributed is controlled.

Yet, another object is the object of providing a marketing device which can selectively be operated to permit a given customer to receive a prize on demand.

Yet, another object is the object of providing a marketing and prize distribution device which will distribute the prizes with a great deal of sound and flashing lights to attract additional attention to the marketing device.

These and other objects and advantages will be apparent upon reading the brief description of the drawings and the description of the preferred embodiment.

DESCRIPTION OF THE PREFERRED EMBODIMENT

Figure 1:
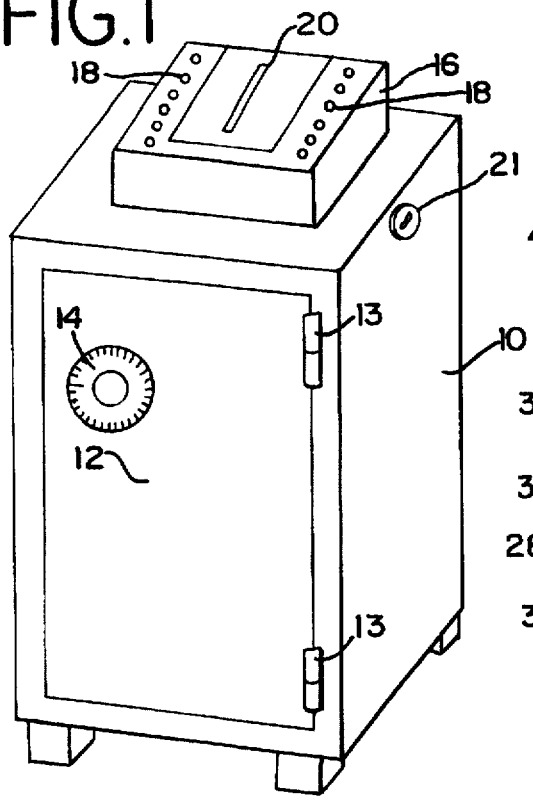
FIG. 1 is a perspective view of the marketing device shown as a safe having a slot through which players drop a card.

Turning first to FIG. 1, there is illustrated a prize distribution device or safe 10 of the present invention. It has a conventional door 12 which pivots around hinges 3 and is normally opened by means of the user dialing in a secret combination by means of the tumbler dial 14. On the top of the safe is a control panel 16. In the embodiment shown in FIG. 1, the control panel 16 has a plurality of lights 18 along either side. There is a slot 20 in which players drop business cards or tickets. There is a manual override by which the safe 10 can be opened by placing a key into keyhole 21 to allow opening the safe to place prizes therein or to gain access to the internal circuitry.

Figure 2:
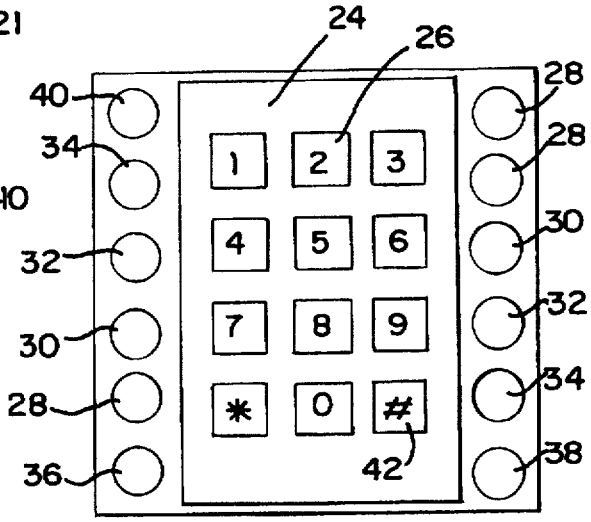
FIG. 2 is a top view of an alternate keypad device by which players can input numbers in an effort to win a prize.

FIG. 2 illustrates an alternative to the control panel 16. In the alternative embodiment of FIG. 2, a control panel 22 still has the plurality of lights 18, but instead of the slot 20, there is a keypad 24. There are a plurality of buttons 26 similar to the pushbuttons on a telephone.

Figure 3:
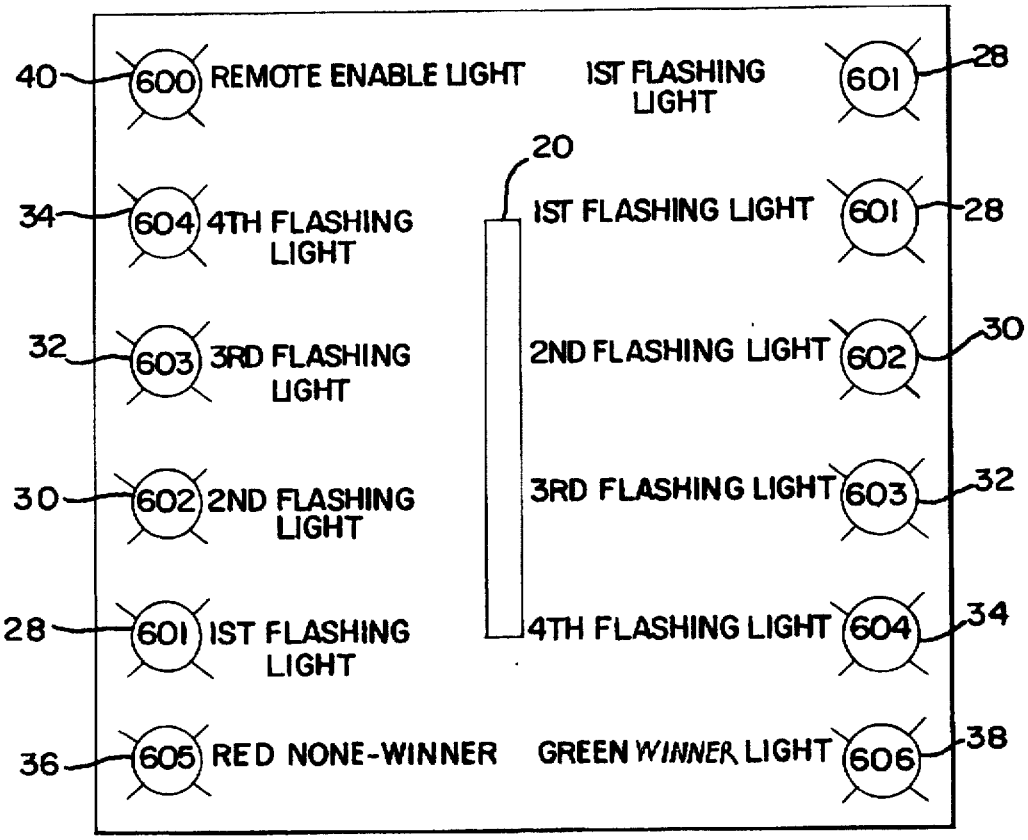
FIG. 3 is a top plan view of the slot input device illustrated in FIG. 1.

Turning to FIG. 3, the control panel 16 of FIG. 1 is more fully illustrated. When the unit is energized, the lights 18 flash in a sequence. There is a group of first colored flashing lights 28, a pair of second colored flashing lights 30, a pair of third colored flashing lights 32, and a pair of fourth colored flashing lights 34. All of the lights continually go through a preset blinking sequence. There is a non-winner red light 36 and a green winner light 38. There is also a remote enable light 40 which indicates that the safe 10 can be operated by means of a remote controller which will be described in more detail later.

Figure 4:
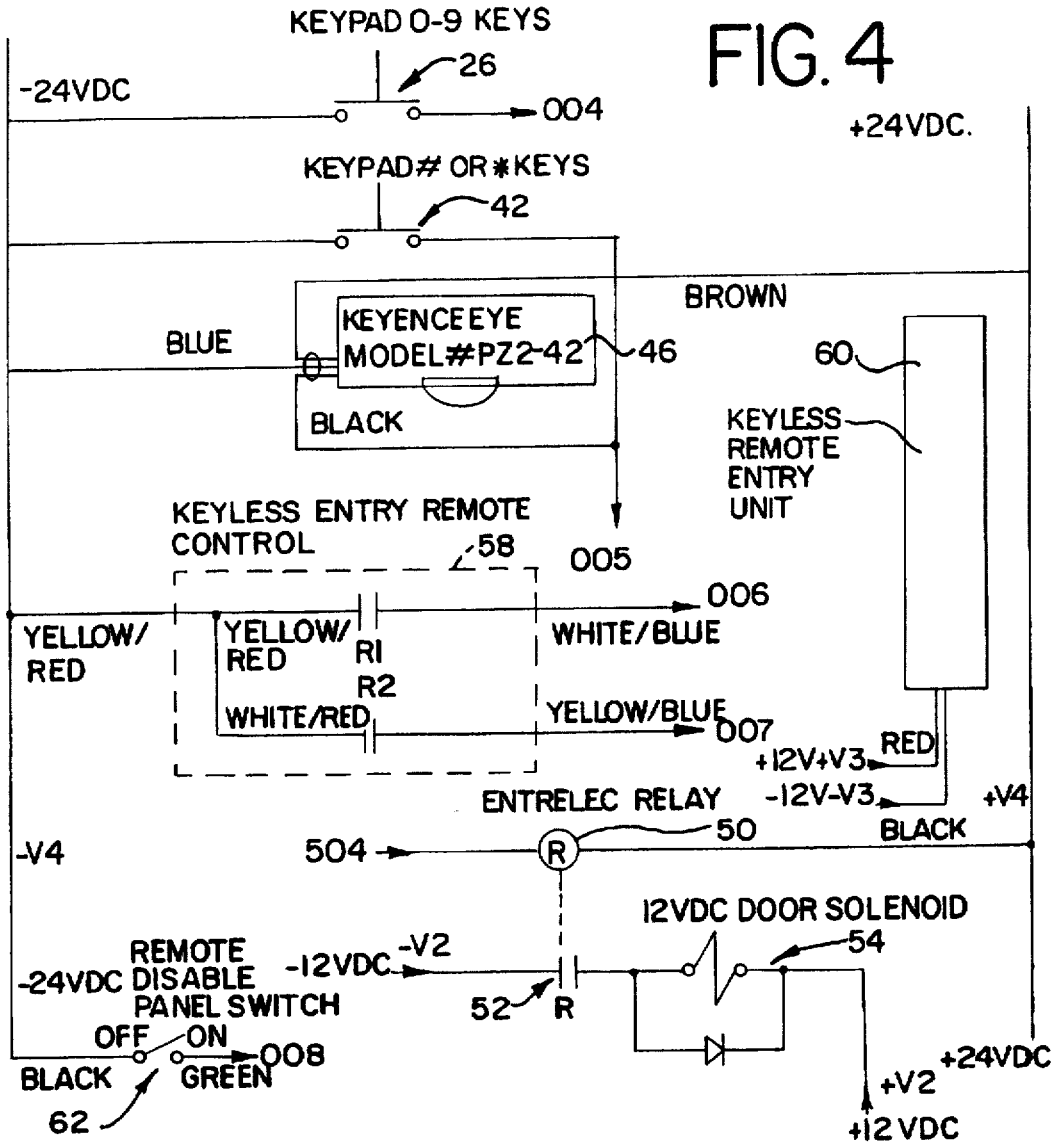
FIG. 4 is a schematic drawing of a portion of the electronic circuitry to operate the device.

Turning to FIG. 4, we can see part of the schematic of the electronic circuitry. The buttons 26 on the keypad 24 are not necessary to operate the device and are only there to enable a player to enter his or her favorite number. Not until the player enters a # button 42 on the keyboard is a signal sent to a counter in a microprocessor 44. Similarly, an electric eye 46 will send a signal to the microprocessor 44 each time a card or ticket is dropped through the slot 20.

Figure 5:
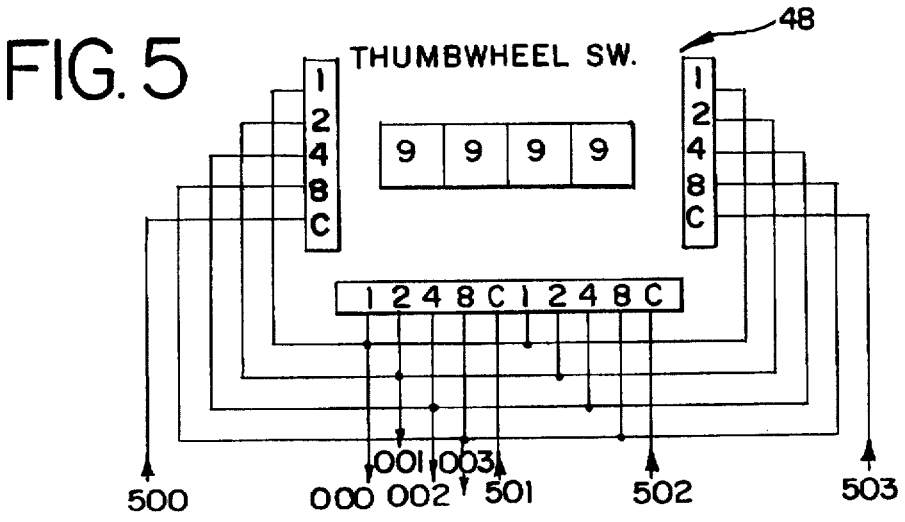
FIG. 5 is a schematic diagram of the wiring to the thumbwheel switch which sets the target number.
Figures 6, 7:
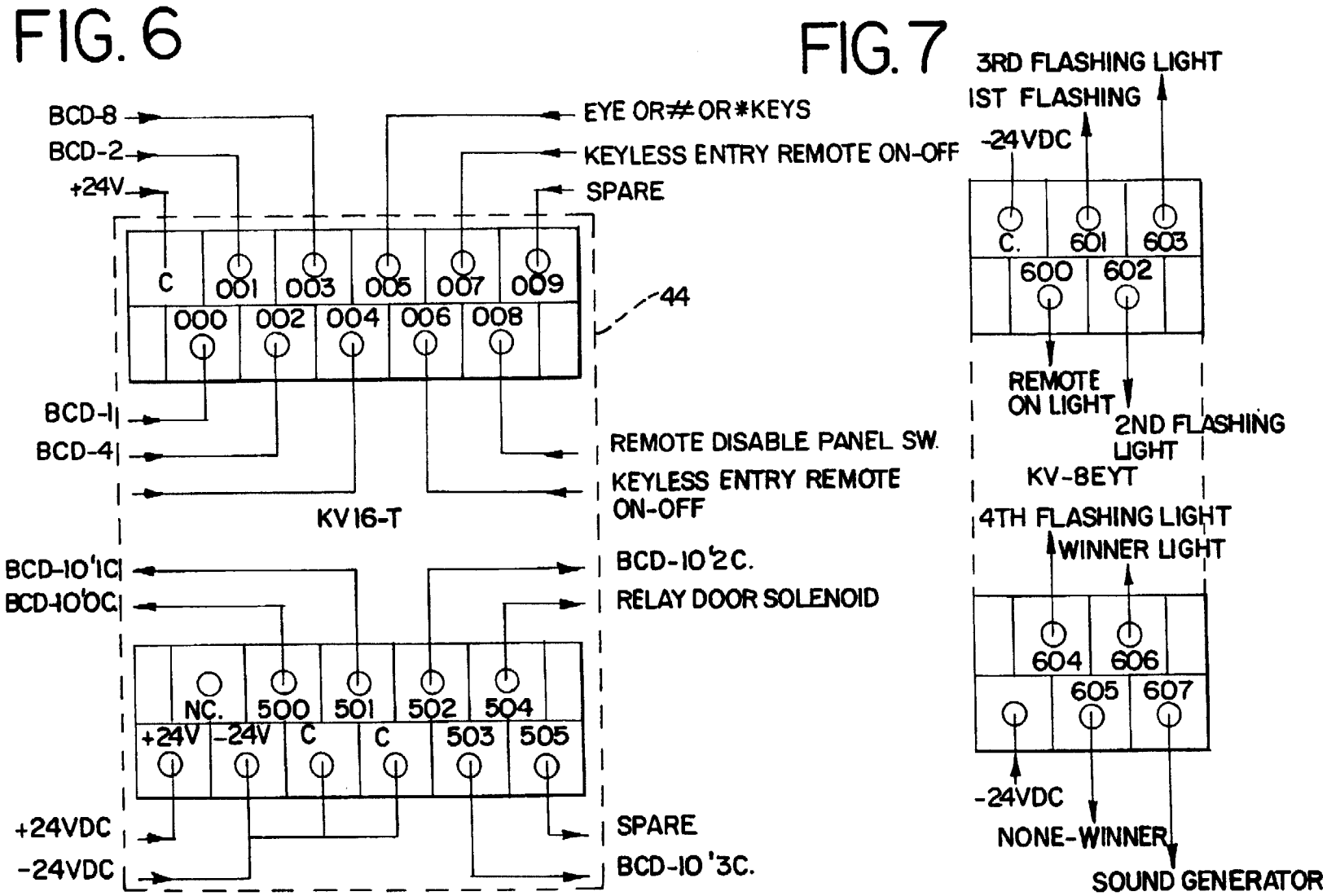
FIG. 6 is a schematic diagram of one of the microprocessors used in the control circuitry.
FIG. 7 is a schematic diagram of another microprocessor used to control the flashing lights.
Figure 8:
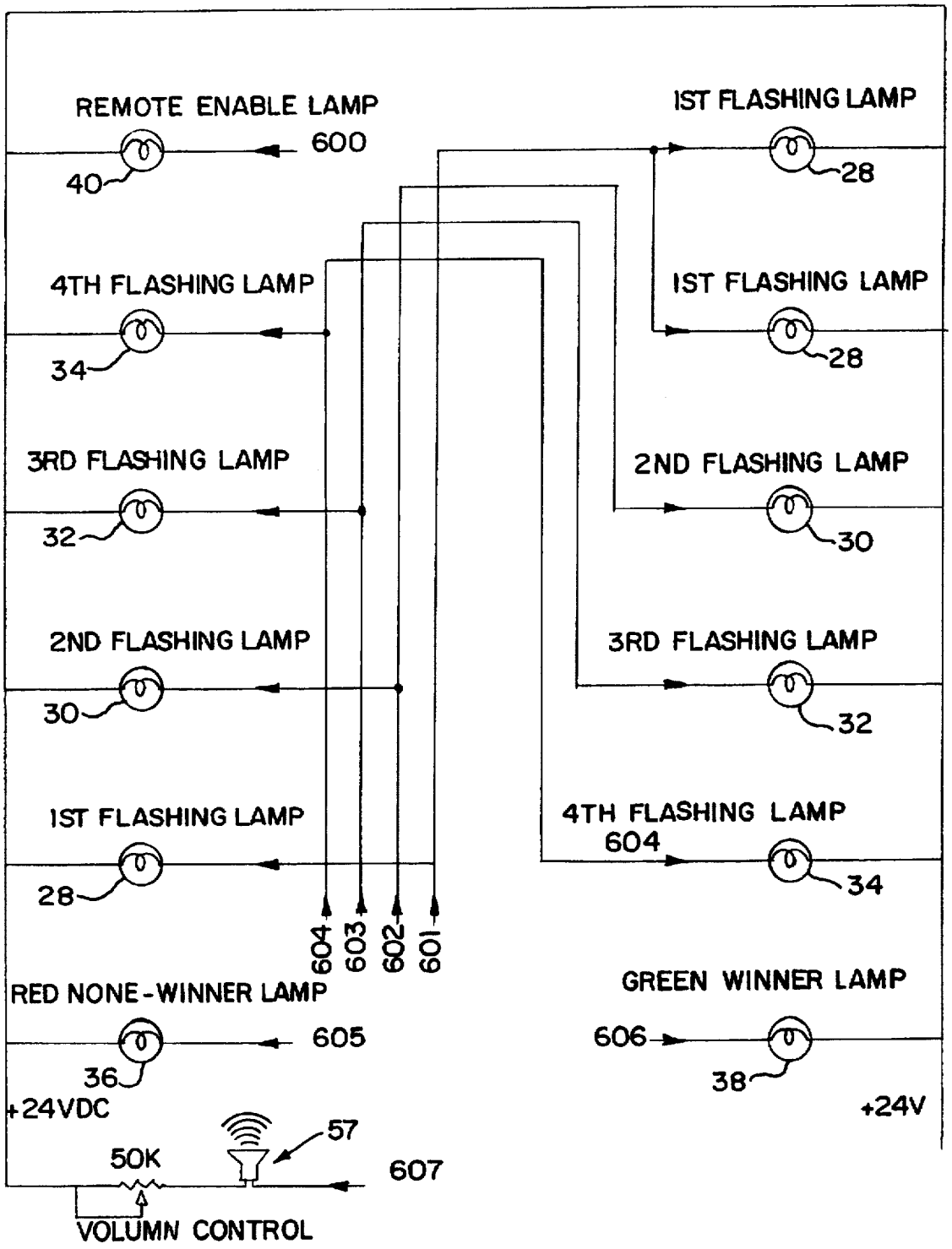
FIG. 8 is a schematic diagram of the outputs from the microprocessor illustrated in FIG. 7 to the output flashing lights and auditory signals.

A thumbwheel switch 48 (illustrated in FIG. 5) is mounted inside the safe 10 on the back wall. The proprietor of the device enters a number from 1 to 9999 on the thumbwheel 48. The thumbwheel switch 48 is connected to the microprocessor 44 by means of connections BCD-1, BCD-2, BCD-4, BCD-8, BCD-10'0C, BCD 10'IC, BCD-10'2C, and BCD-10'3C.

When the number of input signals sent by the # button 42 or electric eye 36 is less than the number set on the thumbwheel switch 48, a non-winner output signal is sent at 605 to illuminate the non-winner light 36. When the number of input signals sent by the # button 42 or electric eye 46 equals the number set on the thumbwheel switch 48, the microprocessor 44 generates an output signal at 504 to a relay 50. This closes contact 52 which in turn energizes a door solenoid 54. The door solenoid 54 is operatively connected to a latch which keeps the door 12 closed and locked. When the solenoid 54 is actuated, the latch is released and the door 12 springs open. At the same time, the microprocessor 44 sends a signal to microprocessor 56 which controls the flashing lights and other outputs. A winner light signal is generated at 606 from the microprocessor 56 which illuminates light 38. A sound generating signal is also transmitted at 607 which is connected to either a bell, whistle, or other sound generator 57. Thus, when the comparitor within the microprocessor 44 shows that the thumbwheel 48 and number of input signals are equal, the door 12 is opened amid a flurry of flashing lights and sounds.

Also, as seen in FIG. 4, there is a keyless entry remote control 58. This can be either an infrared or other radio frequency transmitter which the proprietor can keep in his pocket. When a selected person or customer approaches and is going to attempt to win the prize contained within the safe 10, the proprietor pushes a button on the keyless remote control 58. This is received by a receiving unit 60 within the safe 10. This in turn sends a signal to the microprocessor 44 at 006 which in turn sends the signal to the relay door solenoid 50 so that the solenoid 54 is energized. Furthermore, the winner light 38 is energized and the sound generator signal is also transmitted. This allows the proprietor to essentially override the comparitor within the microprocessor 44. The remote control unit 58 can be separately disabled by means of a switch 62. When the switch 62 is in the "on" position, the remote enable light 40 is illuminated.

The interconnections between the microprocessors, input, and output devices are clearly illustrated in the schematics illustrated in FIGS. 4 through 8.

Thus, there has been provided a process for the manufacture of a safe for distributing prizes that fully satisfies the objects, aims, and advantages set forth herein. While the invention has been described in conjunction with a specific embodiment, it is evident that many alternatives, modifications, and variations will be apparent to those skilled in the art in light of the foregoing description. Accordingly, it is intended to embrace all such alternatives, modifications, and variations as fall within the spirit and scope of the appended claims.

What is claimed is:

1. A portable safe for distributing prizes comprising:

a door on the safe;

latch means for controlling the opening of the door;

user generated input means which generates a countable input signal each time said user generated input means is activated by a user, the input means comprising a card receiving enclosure with a card receiving slot therein, an electric eye mounted adjacent to the slot and within the card receiving enclosure which is activated and sends the countable input signal each time a card is dropped through the slot with the cards being retained in the card receiving enclosure;

means for receiving each of the generated countable signals;

counter means for counting the number of received countable input signals, the counter means having an adjustable target number;

comparison means for comparing the number of countable input signals counted by the counter means to the target number;

first latch releasing means for releasing the latch means when the number of input signals equals the target number;

remote control latch releasing means for releasing the latch means responsive to receipt of a remote control signal;

whereby a prize placed in the safe can be retrieved when the safe door is opened by the first latch releasing means when the number of counted input signals equals the target number or when the remote control latch releasing means receives the remote control signal.

2. The device of claim 1 wherein the first latch releasing means comprises an electric solenoid operatively connected to the latch means, the solenoid operated when the number of counted input signals equals the target number.

3. The device of claim 2 wherein the remote control latch releasing means comprises a radio frequency transmitter which sends a signal to a receiver operatively connected to the electric solenoid which releases the latch releasing means when the transmitter is operated.

4. The device of claim 1 wherein the counter means has an adjustable thumbwheel for setting the target number.

5. The device of claim 1 and further comprising output devices operated responsive to operation of latch releasing means.

6. The device of claim 5 wherein the output devices comprise lights and an auditory signalling device.

7. A portable safe comprising: an enclosed compartment having an access door for allowing access to the interior of the compartment;

a locking mechanism having an electric solenoid controlled latch for controlling the opening of the access door;

input means for generating a countable input signal comprising a card receiving enclosure with a card receiving slot therein, an electric eye mounted adjacent to the slot and within the card receiving enclosure which is activated and sends the countable input signal each time a card is dropped through the slot with the cards being retained in the card receiving enclosure;

means for receiving each of the generated countable signals;

counter means for counting the number of countable input signals, the counter means having an adjustable target number;

comparison means for comparing the number of countable input signals counted by the counter means to the target number;

lock release means for generating a lock release signal to the electric solenoid when the comparison means detects the input signals equal to the target number;

remote control lock release means for generating a remote lock release signal which is received by receiving means operatively connected to the electric solenoid to release the latch;

whereby a prize placed in the enclosed compartment can be retrieved when the access door is opened responsive to either the electric solenoid being operated by the lock release means or the remote control lock release means.

8. The device of claim 7 and further comprising a key to operate the locking mechanism to open the access door.

9. The device of claim 7 wherein the remote control lock release means comprises a radio frequency transmitter.

10. The device of claim 7 wherein the counter means has an adjustable thumbwheel for setting the target number.

11. The device of claim 7 and further comprising output devices operated responsive to operation of the electric solenoid.

12. The device of claim 11 wherein the output devices comprise lights and an auditory signalling device.

* * * * *